United States Patent [19]

Reece

[11] 4,450,229

[45] May 22, 1984

[54] STABILIZATION OF LATENT IMAGES IN PHOTOTHERMOGRAPHIC ELEMENTS

[75] Inventor: Jack E. Reece, Forest Lake Township, Washington County, Minn.

[73] Assignee: Minnesota Mining and Manufacturing Company, St. Paul, Minn.

[21] Appl. No.: 494,262

[22] Filed: May 13, 1983

[51] Int. Cl.[3] ..... G03C 1/02; G03C 1/34

[52] U.S. Cl. ..... 430/523; 430/607; 430/617; 430/619; 430/620; 430/599; 430/531; 430/533; 430/534; 430/536; 430/535; 430/539

[58] Field of Search ..... 430/607, 619, 620, 599, 430/617, 523, 531, 533–536, 539

[56] References Cited

U.S. PATENT DOCUMENTS

| | | | |
|---|---|---|---|
| 3,457,075 | 7/1969 | Morgan et al. | 430/620 |
| 3,549,371 | 12/1970 | Mueller et al. | 430/607 |
| 4,036,649 | 7/1977 | Schwalenstocker, Jr. | 430/599 |
| 4,352,872 | 10/1982 | Reece | 430/523 |

*Primary Examiner*—Won H. Louie, Jr.

*Attorney, Agent, or Firm*—Donald M. Sell; James A. Smith; Mark A. Litman

[57] ABSTRACT

The addition of a class of compounds to a photothermographic emulsion reduces latent image fade.

15 Claims, No Drawings

STABILIZATION OF LATENT IMAGES IN PHOTOTHERMOGRAPHIC ELEMENTS

TECHNICAL FIELD

The present invention relates to silver halide photothermographic emulsions and in particular to latent image stabilization of photothermographic emulsions.

BACKGROUND OF THE ART

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and British Pat. No. 1,110,046 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver which is in catalytic proximity to the specks of the latent image.

The specks or clusters of silver which form the latent image are only partially stable. Materials within the emulsion can oxidize the metallic silver back to an ionic state. This in fact occurs in photothermographic emulsions. The quality and the optical density of a photothermographic image will, because of this latent image decay, in part depend on the time period between exposure and development. The time period over which noticeable latent image fade will occur varies with the ambient conditions, but at room temperature and moderate humidity, visually observable changes can be readily seen with a decay of twelve hours between exposure and development. It would, of course, be desirable to reduce latent image fade in photothermographic emulsions without adversely affecting the sensitometry of the emulsion or requiring extensive formulation changes.

The use of diazepines and fused aromatic diazepines to stabilize latent image fade is disclosed in U.S. Pat. No. 4,352,872. It would be desirable to provide less expensive materials and compounds which are more easily synthesized to perform the same stabilization.

SUMMARY OF THE INVENTION

The addition of certain diamine derivatives to photothermographic emulsions has been found to suppress latent image fade and also, in some instances, to modestly increase the relative speed of the emulsions.

The diamine derivatives of the present invention which are capable of providing latent image stabilization are represented by the formula:

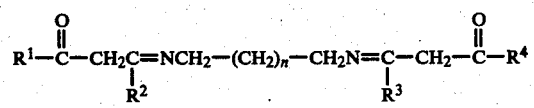

wherein $R^1$ and $R^4$ are independently selected from hydrogen and alkyl groups of 1 to 4 carbon atoms, $R^2$ and $R^3$ are independently selected from hydrogen and alkyl groups of 1 to 4 carbon atoms, and n is zero or a positive whole integer between 1 and 4.

DETAILED DESCRIPTION OF THE INVENTION

Photothermographic emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of each layer, and preferably about 30 to 55 percent by weight.

In describing materials useful according to the present invention, the use of the term 'group' to characterize a class, such as alkyl group, indicates that substitution of the species of that class is anticipated and included within that description. For example, alkyl group includes hydroxy, halogen, ether, nitro, aryl and carboxy substitution while alkyl or alkyl radical includes only unsubstituted alkyl.

The latent image stabilizers may be present in any effective amount. This is usually in the range of 0.001 to 0.5 percent by weight of the material in the imaging layer. The stabilizer may be added to the top layer in a two coat system, but it must migrate in an effective amount into the image layer to be useful according to the practice of the present invention.

As previously noted, various other adjuvants may be added to the photothermogarphic emulsions of the present invention. For example, toners, accelerators, acutance dyes, sensitizers, stabilizers, surfactants, lubricants, coating aids, antifoggants, leuco dyes, chelating agents, and various other well known additives may be usefully incorporated.

Preferred compounds of the invention, as represented by the formula given above, are symmetrical. That is, $R^1$ is the same as $R^4$ and $R^2$ is the same as $R^3$. Those compounds simplify synthesis according to the procedures taught by G. Schwartzenbach and K. Lutz, *Helv. Chim. Acta* 23 1134 (1940). More preferred compounds are those where all R groups are alkyl of 1 to 4 carbon atoms and n is zero and the most preferred compound is where all R groups are methyl and n is zero.

A simple test has been used in the following examples to determine the relative effectiveness of the compounds of the present invention. A standard photothermographic emulsion was prepared without any latent image stabilizer therein. Two strips of the standard film and two strips of each of the films with the additives of the present invention were exposed for one millisecond on a Mark VII, E.G. and G. sensitometer to a 5000 m-candle sec xenon flash. One strip of each pair of film samples was immediately developed by heating at 125°–130° C. for twenty seconds. Each of the other samples was placed in an oven at 60° C. for twenty minutes and then developed in the same manner. The apparent energy of the exposure (Log E) needed to generate an optical density of 1.0 upon this standard development was determined. The increase in energy needed to obtain this optical density between identically composed samples was termed latent image fade and is expressed as Log E units. All percentages, unless otherwise indicated in the discussion of compositions, are weight percentages.

PREPARATION

A master emulsion was prepared for use in all of the examples of the present invention as follows:

Three thousand grams of a dispersion containing 12.5 percent by weight silver behenate, 6.5 percent methyl isobutyl ketone, 21 percent toluene, and 60 percent methyl ethyl ketone were added to a stirred reaction vessel and maintained at 15 C. Forty-five (45) grams of polyvinyl butyral and thirty (30) grams 1-methyl-2-pyrrolidinone were added with stirring. At twenty minute intervals, the following additions were made:

(1) a mixture of 75 ml 2 M HBr and 20 ml 0.1 M HI in ethanol, (2) 330 grams polyvinyl butyral and 15 ml 0.5 M $HgBr_2$ in ethanol, and (3) 80 mg of the sensitizing dye

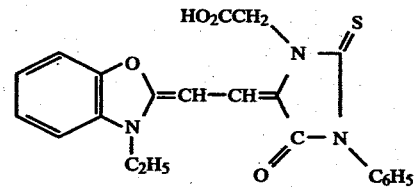

in 16 ml of 1-methyl-2-pyrrolidinone.

The mixture was digested with stirring for twenty minutes.

To a 700 gram aliquot of this master batch was added 9 grams of a hindered phenol developer (1,1-bis(2-hydroxy-3,5-dimethylphenyl)-3,5,5-trimethylhexane) and 3 grams of phthalazinone. After stirring for 20 minutes at 15° C., this was knife-coated at 100 microns wet thickness onto polyester and dried in a forced draft at 85° C. for 4 minutes. Top coats containing the additives of the present invention (or nothing in the case of the control) in a 5 percent solids solution of a polyvinyl acetate/polyvinyl chloride copolymer (80/20) in methyl ethyl ketone were applied to the dried first coating at 75 microns wet thickness and dried in the same manner as the first coating.

EXAMPLES 1–12

In evaluating materials according to these examples, six strips of each sample are tested. Each strip was exposed for $10^{-3}$ seconds using an E.G. and G. MK VII sensitometer with a 0-4 continuous density wedge. Half the strips of each sample were processed immediately for twenty seconds at 127° C. The remaining strips were stored for twenty minutes in a forced draft oven at 60° C. and then developed by heating for twenty seconds at 127° C. The amount of latent image fade was determined by noting the difference in the amount of the energy of exposure ($Log_{10}E$) necessary to produce an optical density of 1.0 between the immediately developed strip and the aged strip. That is, the Latent Image Fade (L.I.F.) equal the $Log_{10} E_{1.0}$ of the aged material (Log $E_a$) minus the $Log_{10} E_{1.0}$ of the initial material (Log $E_i$). In the following Examples, the compound

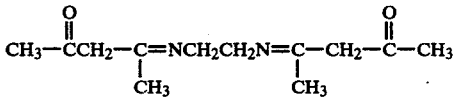

was used in the amounts (weight percent of the layer in which the compound is incorporated) shown in the Table which also shows the recorded results. Examples 1–6 have the stabilizer present in the overcoat layer and Examples 7–12 have the stabilizer present in the silver image layer.

TABLE

| Ex. | Amount (wt %) | L.I.F. |
|---|---|---|
| 1 | 0 | 0.72 |
| 2 | 0.005 | 0.63 |
| 3 | 0.01 | 0.51 |
| 4 | 0.02 | 0.33 |
| 5 | 0.03 | 0.32 |
| 6 | 0.04 | 0.29 |
| 7 | 0 | 0.70 |
| 8 | 0.005 | 0.35 |
| 9 | 0.01 | 0.26 |
| 10 | 0.02 | 0.20 |
| 11 | 0.03 | 0.20 |
| 12 | 0.04 | 0.14 |

The stabilizing effects of the compounds of the present invention can be readily seen from these data.

The compound of the examples was prepared by reacting one part ethylene diamine with two parts acetyl acetone in aqueous solution at reduced temperature as follows: acetyl acetone was slurried in water (1 mole/500 g) and chilled to 10° C. using an ice bath. Dropwise addition of acqueous ethylene diamine (1 mole/300 g) with stirring at 10°–20° C. yielded a white precipitate. Filtering, recrystallizing (water), and air-drying this precipitate yielded the desired compound, mp 108°–110° C. in about 40–45% yield. The literature reports 111.5° C.

I claim:

1. A photothermographic element comprising a binder, light sensitive silver halide in catalytic proximity to a light insensitive silver source material in said element which contains a reducible source of silver ions, a reducing agent for silver ion and an effective latent image stabilizing amount of a compound of the formula

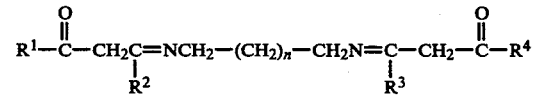

wherein $R^1$ and $R^4$ are independently selected from hydrogen and alkyl groups of 1 to 4 carbon atoms, $R^2$ and $R^3$ are independently selected from hydrogen and alkyl groups of 1 to 4 carbon atoms, and n is zero or a positive whole integer between 1 and 4.

2. The photothermographic element of claim 1 wherein said binder, silver halide, silver source material, reducing agent and said compound are present in a single layer.

3. The photothermographic element of claim 1 wherein said compound is in a layer adjacent to a layer containing both of said silver halide and said silver source material.

4. The photothermographic element of claim 3 wherein said element comprises (1) a substrate, (2) an emulsion layer comprising a binder and light sensitive silver halide in catalytic proximity to said silver source material, and (3) an overcoat layer comprising a binder and said compound.

5. The photothermographic emulsion of claim 1 wherein n is zero, and $R^1$, $R^2$, $R^3$ and $R^4$ are independently alkyl of 1 to 4 carbon atoms.

6. The photothermographic emulsion of claim 2 wherein n is zero, and $R^1$, $R^2$, $R^3$ and $R^4$ are independently alkyl of 1 to 4 carbon atoms.

7. The photothermographic emulsion of claim 3 wherein n is zero, and $R^1$, $R^2$, $R^3$ and $R^4$ are independently alkyl of 1 to 4 carbon atoms.

8. The photothermographic emulsion of claim 4 wherein n is zero, and $R^1$, $R^2$, $R^3$ and $R^4$ are independently alkyl of 1 to 4 carbon atoms.

9. The photothermographic emulsion of claim 5 wherein each alkyl is methyl.

10. The photothermographic emulsion of claim 6 wherein each alkyl is methyl.

11. The photothermographic emulsion of claim 7 wherein each alkyl is methyl.

12. The photothermographic emulsion of claim 8 wherein each alkyl is methyl.

13. The photothermographic element of claim 5 wherein said silver source material is a silver salt of a 10 to 30 carbon atom carboxylic acid.

14. The photothermographic element of claim 1 wherein within one single layer said binder comprises 20 to 75 percent by weight of said single layer, said silver halide comprises 0.75 to 15 percent by weight of said single layer, said silver source material comprises a silver salt of a 10 to 30 carbon atom carboxylic acid of from 20 to 70 percent by weight of said single layer, said reducing agent comprises from 1 to 10 percent by weight of said single layer, and said compound comprises from 0.001 to 0.5 percent by weight of said single layer.

15. The photothermographic element of claim 5 wherein said emulsion layer is comprised of 20 to 75 percent by weight binder, 0.75 to 15 percent by weight silver halide, 20 to 70 percent silver source material, and 1 to 10 percent by weight of reducing agent for silver ion, and said overcoat layer comprises a binder with 0.001 to 0.5 percent by weight of said compound.

* * * * *